United States Patent [19]

Heidkamp

[11] 3,939,680

[45] Feb. 24, 1976

[54] INSTALLATION FOR MOUNTING A DOOR PANEL OR ROSETTE ON A DOOR

[75] Inventor: Karl-Josef Heidkamp, Velbert, Germany

[73] Assignee: Otto Grosssteinbeck GmbH, Velbert, Germany

[22] Filed: May 1, 1973

[21] Appl. No.: 356,191

[30] Foreign Application Priority Data

May 9, 1972 Germany ..... 2222717

[52] U.S. Cl. ..... 70/452

[51] Int. Cl.² ..... E05B 15/02

[58] Field of Search ..... 70/451, 452, 370; 85/DIG. 2

[56] References Cited

UNITED STATES PATENTS

| | | | |
|---|---|---|---|
| 862,230 | 8/1907 | Young | 70/153 |

FOREIGN PATENTS OR APPLICATIONS

| | | | |
|---|---|---|---|
| 1,428,509 | 1/1969 | Germany | 70/452 |
| 1,225,548 | 3/1971 | United Kingdom | 70/452 |
| 1,553,509 | 10/1969 | Germany | 70/451 |

*Primary Examiner*—Robert L. Wolfe

*Attorney, Agent, or Firm*—Haseltine, Lake & Waters

[57] ABSTRACT

Installation for mounting a door panel or rosette on a door including fastener means such as at least one pin or lock screw extending between the panel and door. The pin is fastened to and extends from the door and is grippingly engaged in a bore formed in a projection of the panel. The pin is mounted in either the door or a door lock receptacle.

15 Claims, 10 Drawing Figures

INSTALLATION FOR MOUNTING A DOOR PANEL OR ROSETTE ON A DOOR

FIELD OF THE INVENTION

The present invention relates to an installation for mounting a door panel or door rosette on at least one surface of a hollow door which is constructed of wood or metal, and having located therein, so as to extend through the front surface thereof, a receptacle containing the door lock.

DISCUSSION OF THE PRIOR ART

The fastening or mounting of elongate door panels and door rosettes, such as decorative panels and the like, onto doors is beset by various difficulties since, as a rule, due to present mass production techniques the hollow doors may be produced with only comparably thin door panels or covering layers. Consequently, it is no longer possible to effect mounting of the panels or rosettes onto the door by means of wood screws. The foregoing, as a result, has lead to the method of mounting or fastening door panels or rosettes to the doors by means of sleeve screws which extend through the doors, in which the elongate door panels or door rosettes are positioned on opposite sides of the door, and are then fastened together by threaded screws and sleeve nuts. The bores or apertures for positioning these screws are formed during the mass production of the hollow doors, and generally there are provided in each instance, in the regions of the door latch or pusher and key locks, sufficiently large apertures allowing for the passage therethrough of suitable socket-head screws or the like. It has been ascertained that in actuality the axial bracing obtained by this screw gripping engagement is not sufficiently strong when the panels or rosettes are subjected to extensive physical side effects during handling of the door latch or pusher so as to cause opening of the door. Consequently, the socket-head screws could, in view of their lack of rigid engagement, be moved back and forth in response to the aforementioned side effects during the actuation of the door latch or by movement of the door. The consequential back and forth displacement of the door panels or rosettes relative to the door surface caused damage thereto.

SUMMARY OF THE INVENTION

The present invention eliminates the disadvantages encountered in the prior art by providing fastening means for a door panel or rosette for mounting these on a door surface in a manner so as to be completely immovable in the plane of the door.

The fastening means arrangement for mounting the door panel or rosette so as to be rigid and immovable in the plane of the door surface is preferably, although not necessarily, located in the receptacle for the door lock.

In order to provide for a rapid assembly, it is preferable that the mounting arrangement for the door panel ensuring against axial movement thereof relative to the door surface be constituted of pin-and-socket type or clamping connection with the fastening means.

In accordance with an embodiment of the invention, which utilizes at least one fastening pin for mounting of the door panel or of the door rosette, the end of the pin may project beyond the outer surface plane of at least one side of the door, and having positioned in the projecting end there on in a rigidly gripping but detachable relationship, a socket which extends from the rear surface of the door panel toward the door. It is particularly advantageous to dimension the diameters of the socket bore and of the pin so as to ensure a rigid gripping engagement therebetween.

In a further embodiment of the present invention, the door panels or rosettes are mounted on both sides of the door, in which instance the pin may then extend through a through-aperture formed in the door lock.

In the case wherein the door is only covered on one surface thereof by a panel or rosette, it is preferable that the pin be positioned within a sleeve in an axially immovable manner, and in which the sleeve is mounted into a door surface component of the door.

The panel mounting pin may be formed of a circular crosssection. Furthermore, in a particular embodiment, the pin may be provided, proximate one end thereof which is inserted into the door panel socket, with teeth which extend in the longitudinal direction thereof, and which are equidistantly distributed about the circumference of the pin. Additionally, the bore in the door panel projection which receives the mounting pin may have a bore which is conically reduced or tapered in the direction of juncture with the door panel. In this case it is further advantageous that the bore end of the projection adjoining the door panel includes a concentric annular recess which has a cross-section larger than that of the bore and which has a depth somewhat less than the thickness of the door panel.

In accordance with a further embodiment of the invention, the interengaging connection between the door panel and the end of the mounting pin may include an arresting or locking arrangement. In this instance, the end of the pin projecting outwardly of the door surface may be conically tapered, and at its outer free end extend into an annular ring-shaped member of increased size having a diameter which corresponds generally to that of the main shaft portion of the pin. The bore formed in the cooperating door panel projection may be provided with a plurality of axially spaced annular grooves adapted to receive in gripping engagement the annular ring-shaped enlarged member formed at the end of the pin.

In each instance, it is advantageous that the wall extending about the bore of the door panel projection include at the end proximate to its juncture with the door panel at least one longitudinally extending through-slot.

Preferably, the projections, which are generally of cylindrical form, may be constructed of elastically-plastically deformable plastic material integrally formed with the rear surface portion of the door panel, as well as being provided with a through-extending bore for receiving the panel mounting pins.

Furthermore, it has also been ascertained as being advantageous that the cylindrical wall of the projection be made thicker in the region of juncture with the plastic rear surface portion of the panel or rosette.

In accordance with a further embodiment, the fastening means for the door panel may be supported in the body of the door. This particular construction also allows for a simple mounting of the panel or rosette, inasmuch as it is preferable to utilize at least one pin which is connected to the door panel, which includes an elastic hook at the pin end projecting toward the door, and with which the pin may clampingly or fixedly engage corresponding bores or apertures formed in the body of the door and/or in the door lock. In this instance, the pin may comprise a fastening lock screw constituted of a plastic material. The head of the fastening screw is preferably positioned within an aperture located in the plastic material inner surface structure of the door panel which may be fastened to the rear surface of an ornamental metallic door panel or rosette. In view of the foregoing construction, the head of the fastening screw is secured against axial displacement thereof.

In order to facilitate removal of the door panel from the door, it is preferable that the latter be provided along the lower edge thereof with an opening for insertion of a screw driver which will allow prying the door panel, as required, away from the door or from the panel fastener means.

Finally, it is also advantageous that the decorative metallic panel cover plate and the plastic material inner component of the door panel, firmly press against the outer surface plane of the door through the intermediary of a plastic material guide receptacle, providing a pull-resistant pressing connection. In that manner, the door panel is additionally secured against axial displacement thereof.

BRIEF DESCRIPTION OF THE DRAWINGS

Reference may now be had to exemplary embodiments of door panel and rosette mounting arrangements according to the invention, schematically illustrated in the accompanying drawings, in which.

DETAILED DESCRIPTION

Figure 1:
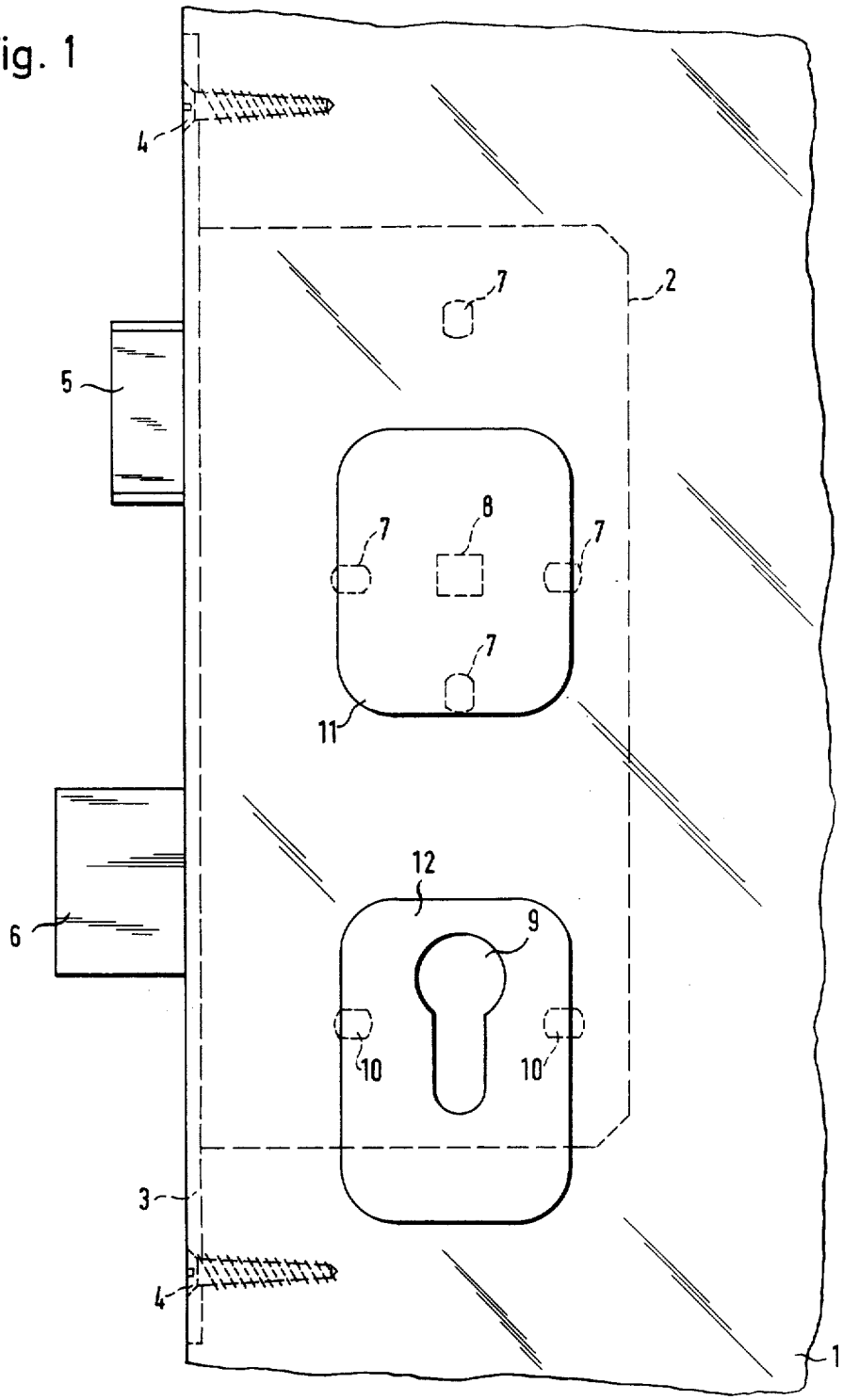
FIG. 1 illustrates a door lock having the usual construction showing the apertures for the lock nut and for the key hole.

Referring now in detail to the drawings, FIG. 1 illustrates a hollow door 1 in which a door lock receptacle 2 is mounted therein so as to extend through the forward surface thereof, and in which a front plate 3 of the lock receptacle is, in a usual manner, screwed into the door by means of suitable wood screws 4. A door latch and a door bolt for the lock are, respectively, designated by reference numerals 5 and 6. The lock receptacle is provided with openings 7 which extend about a lock nut 8. Additionally, further openings 10 are provided on both sides of a key hole 9 in the lock receptacle. The door is provided with cut-outs 11 and 12 in the area of the lock nut 8 and the key hole 9.

Figure 2:
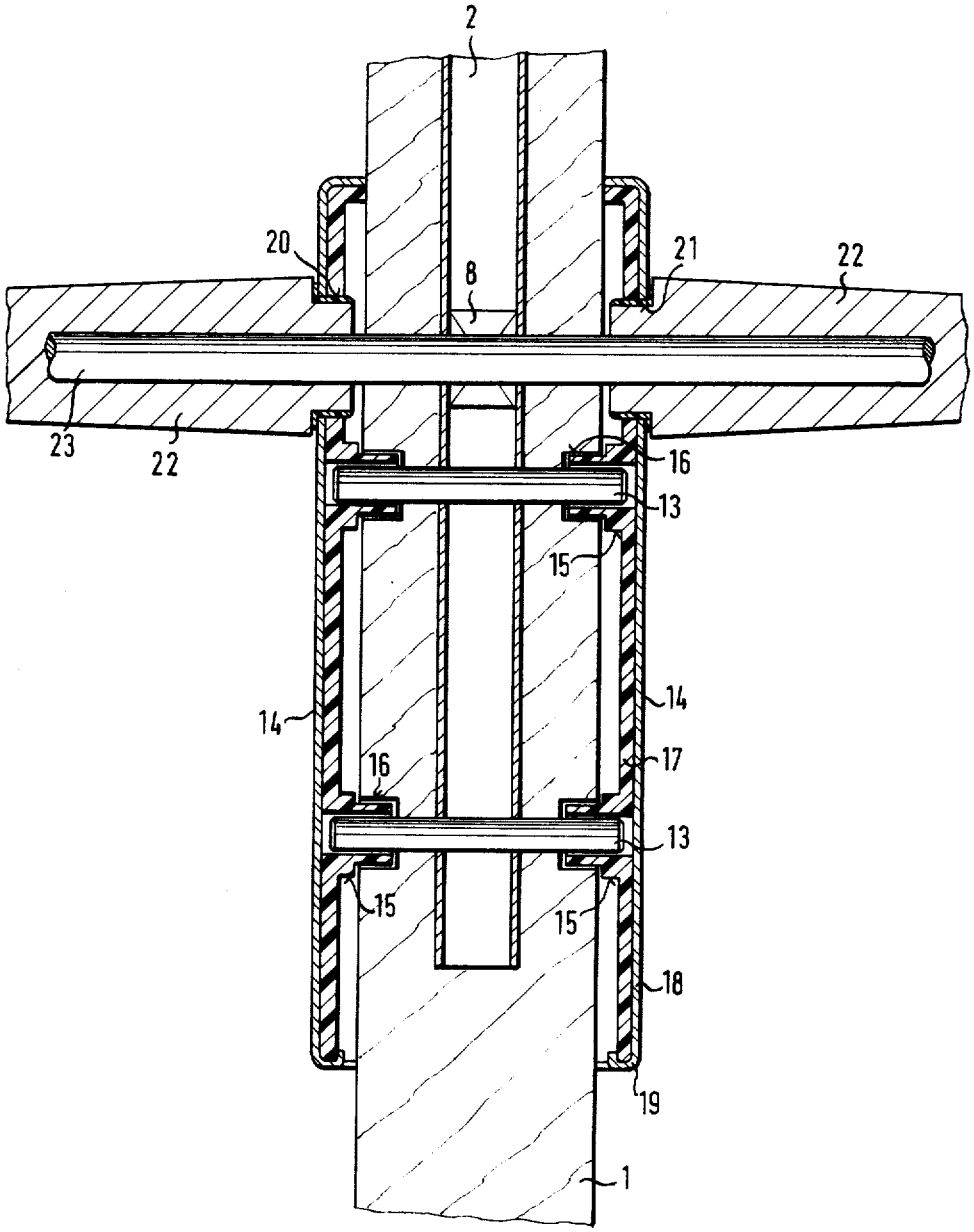
FIG. 2 illustrates, in cross-section, an inventive fastening arrangement for door covering panels onto a hollow door, in which the door panels are supported by means of projections thereon engaging the ends of mounting pins.

In FIG. 2 corresponding elements are designated with the same reference numerals. A fastening pin 13 extends through the aperture 7 in the lock receptacle located below the lock nut 8 in FIG. 1, having a cross-section which corresponds generally to that of the aperture, and dimensioned in a loose or slide fit relative thereto. The ends of the fastening pin 13 project perpendicularly outwardly relative to both opposite outer surface planes of the door. At the projecting ends of the pin there are adapted to be mounted door panels 14 which have projections 15, with cylindrical bores into which the pin ends are inserted so as to provide clamping or gripping engagement therebetween. The projections 15 extend into suitable corresponding recesses 16 formed in the door surface 1.

The projections 15 are integrally formed with a plastic material inner panel plate portion 17, the latter of which fastened to the rear surface of a decorative metal plate 18 which may be, for example, oxidized aluminum, stainless steel, or the like. Along its lower border, the decorative metal plate 18 may be inwardly bent at its edges 19 so as to encompass the lower edge of the plastic inner panel plate portion 17. The aperture or recess thereby formed along the lower edge of the door panel is adapted to permit the insertion of, for example, a screw driver so as to facilitate removal or plying of the door panel from the fastening pins 13. The upper portion of the door panel may, as usual, be provided with enlarged dimension apertures 20, through which extend guide sleeves 21 formed of polytehafluoroethylene, and which concurrently serve as slide supports or bushings for the shafts 22 of door handles, or actuators (not shown). The door actuators are, in a manner known, connected to each other by means of suitable pressure rod 23 which extends through the lock nut 8. The door actuator connection is, in a manner known per se, formed so that one of the rods by means of a locking spring connected therewith, extends into a toothed segment of the pressure rod so that, when the door pressure actuators are pressed as far as possible into the position shown in FIG. 2, they are tightly interconnected with each other. This indicates that also the door panels 14 are retained against the outer surfaces of the door by the door actuator connection structure.

Figure 3:
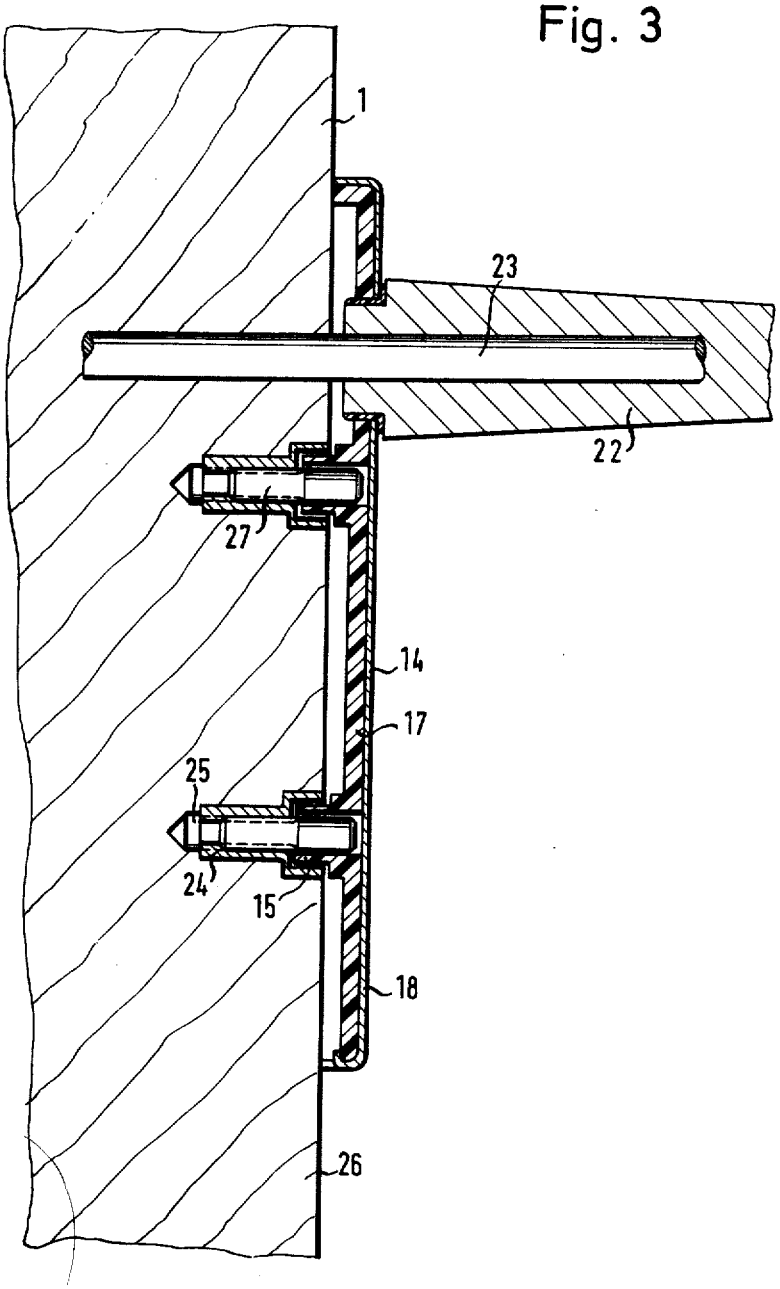
FIG. 3 illustrates, in cross-section, and inventive fastening arrangement for a door covering panel on one side only of a door by means of a fastening sleeve extending into and fastened to the door, and including a fastening pin anchored therein for supporting the door panel.

In the embodiment according to FIG. 3, a door panel 14 is mounted on only one surface of the door. For this purpose, internally threaded sleeves 24 are screwed into apertures 25 extending normal to the plane of the door outer surface 26. The threaded sleeves 24 are mated along the internal thread portion thereof with cylindrical pins 27 having an externally threaded portion. These pins, as previously described, project at one end thereof beyond the outer surface plane of the door. At this pin end there may be mounted a door panel as described in connection with the embodiment of FIG. 2, in effect, mounted by means of the pin-gripping projections 15.

Figure 4:
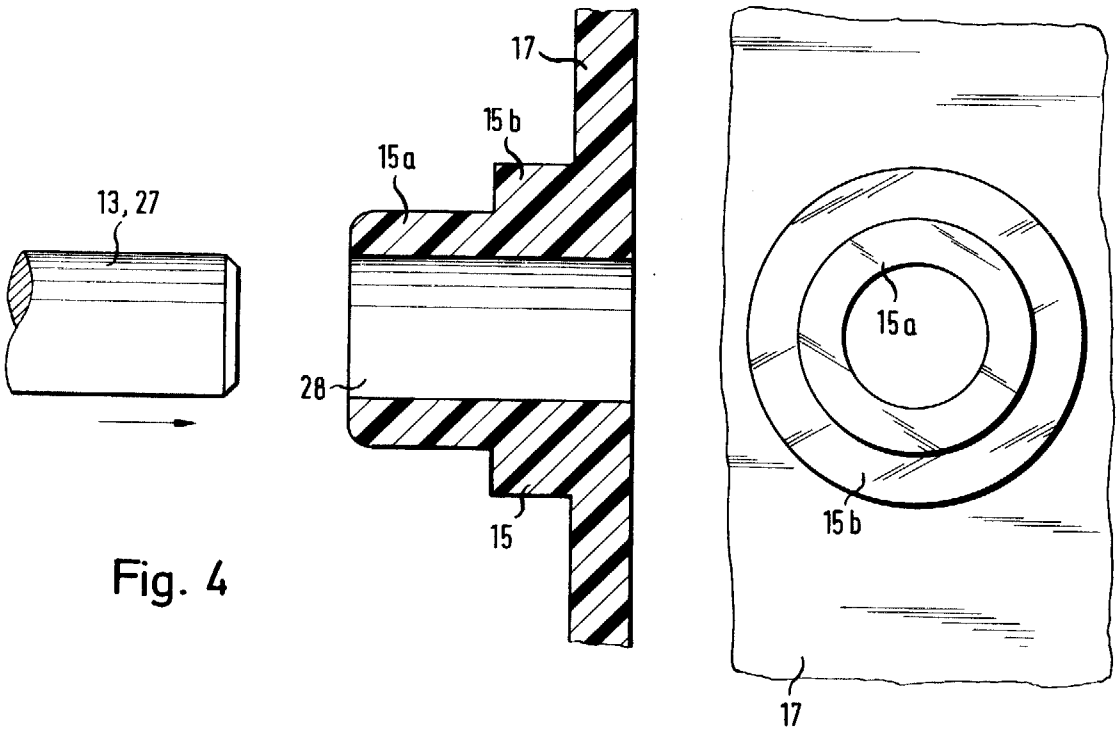
FIG. 4 shows a detailed view, on an enlarged scale, of the cooperative panel projection and fastening pin, with a cylindrical bore formed in the projection and with the crosssection of the fastening pin being circular, the projection and pin being shown in longitudinal section and in plan end view.

FIG. 4 illustrates, in enlarged detail, a panel mounting connection as shown in the arrangement of FIGS. 2 and 3. The projection 15 includes a cylindrical bore 28 having a crosssection which corresponds to the shape of pins 13 or 27, but dimensioned so as to provide an interference fit or gripping engagement between both components. The plastic material inner panel plate portion 17 formed integrally with projections 15 permits an elastically-plastic deformation thereof. In order to ensure that a rigid gripping engagement is provided with the pin, the peripheral wall of the projection 15 from the end thereof contacted by the pins 13, 27 is step-wise enlarged relative from a forward portion 15*a* toward a rearwardly positioned portion 15*b* which extends into the plate-shaped plastic material inner panel portion 17. In view of the foregoing, the resistance to radial deformation of the bore wall of the projection 15 increases in proportion to the extent in which the projection 15 is moved onto the end of the pin.

Figure 5:
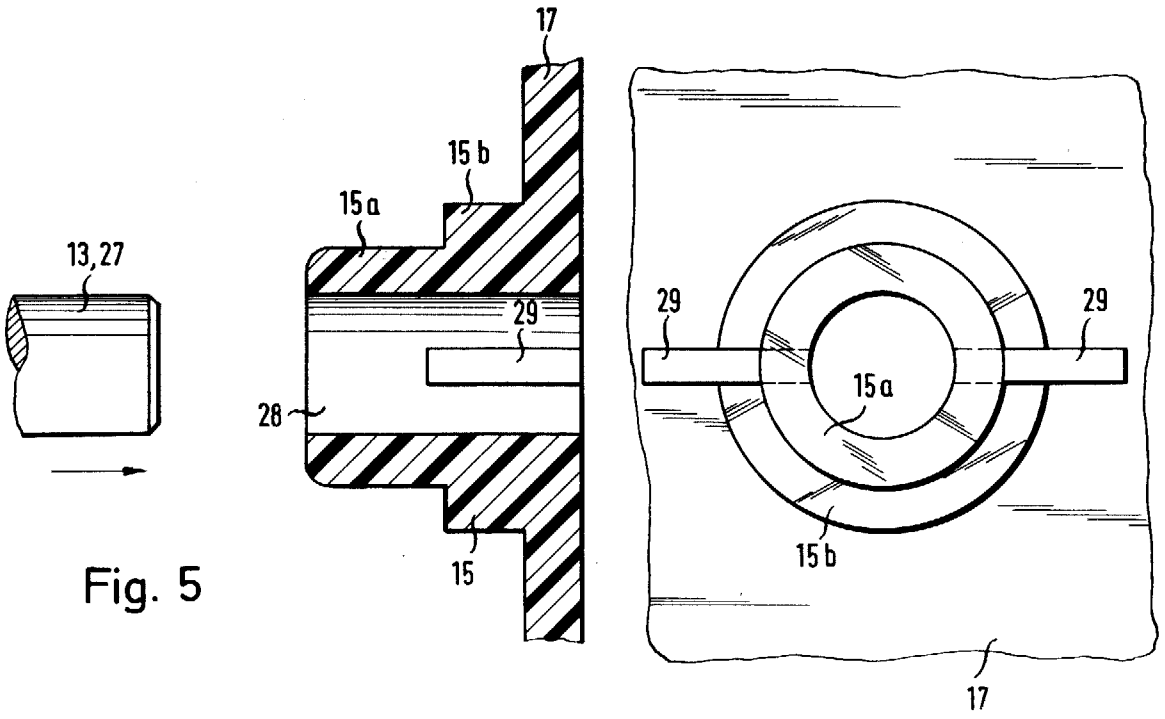
FIG. 5 illustrates a gripping or interference-fit connection between the projection and pin arrangement of FIG. 4, showing diametrically opposed slits being formed in the projection side wall at longitudinal end thereof remote from the pin.

A modified embodiment of the projection of FIG. 4 is illustrated in FIG. 5, in which the projection has extending through its peripheral wall at the end which is spaced from the inserting end for pins 13, 27, diametrically opposed slits 29 which in a particularly important manner fully extend through the annular shoulder portion 15*b* at its circumference as well as its forward end surface adjoining portion 15*a*, and into the plate-shaped plastic material inner portion 17. It is readily understood that this construction provides for an extremely fine determination of the degree of elasticity of the projection 15 upon mounting the bore 28 of the projection onto the corresponding engaged ends of the pins 13, 27.

Figure 6:
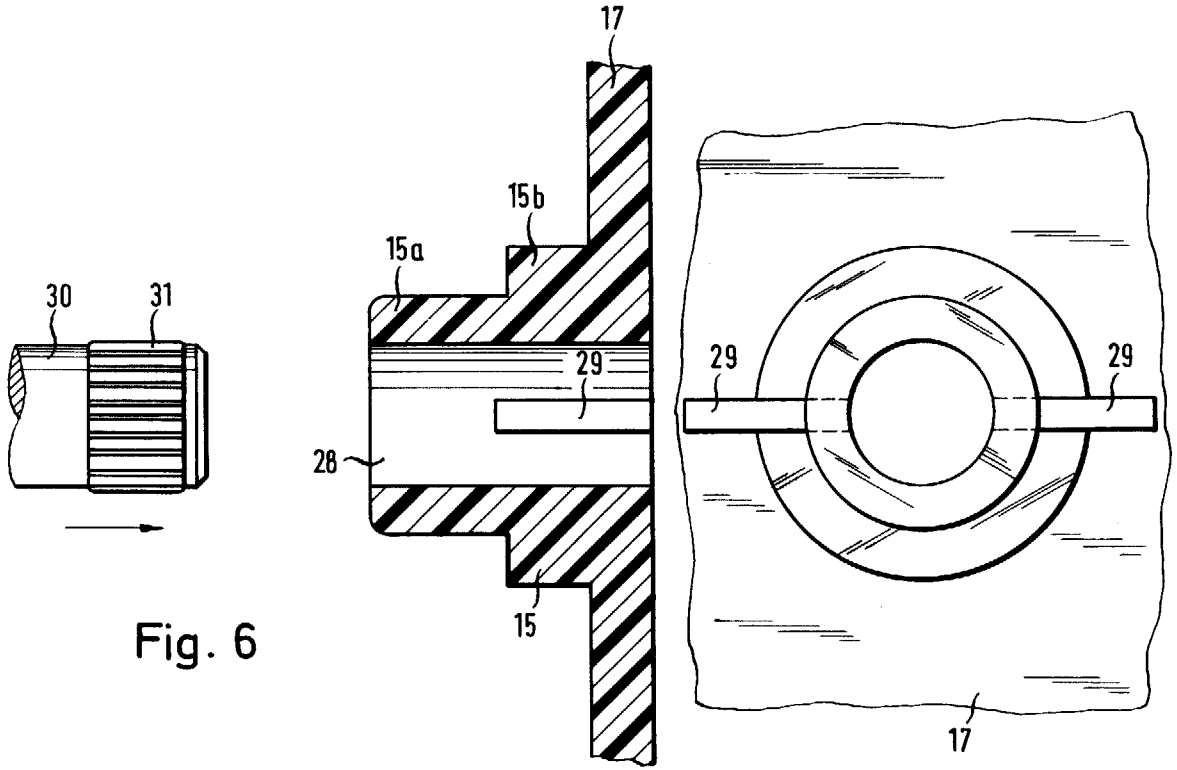
FIG. 6 illustrates a modified gripping arrangement between the projection and pin, in which the projection is formed essentially as in FIG. 5, and wherein the pin end engaging the projection bore includes a plurality of axially extending splines or teeth spaced about the circumference thereof.

In the embodiment of FIG. 6 the construction of the door panel projection 15 is quite similar to that of the construction shown in FIG. 5, as indicated by corresponding reference numerals.

In the foregoing embodiment, the projection-engaging end of a pin 30 is provided with a plurality of axially extending parallel teeth or splines 31, which extend along a relatively short longitudinal segment about the circumference of the pin. When inserted into the projections of the door panel, as described in greater detail in FIG. 5, this structure provides for a fastening connection in which the teeth 31 are partly embedded into the plastic material of the projection 15, the latter of which, on the other hand, is adapted to avoid in view of its elasticity the additional radial pressure imparted by the teeth so as to provide for a rigid but separable gripping engagement between the pin and the projection.

Figure 7:
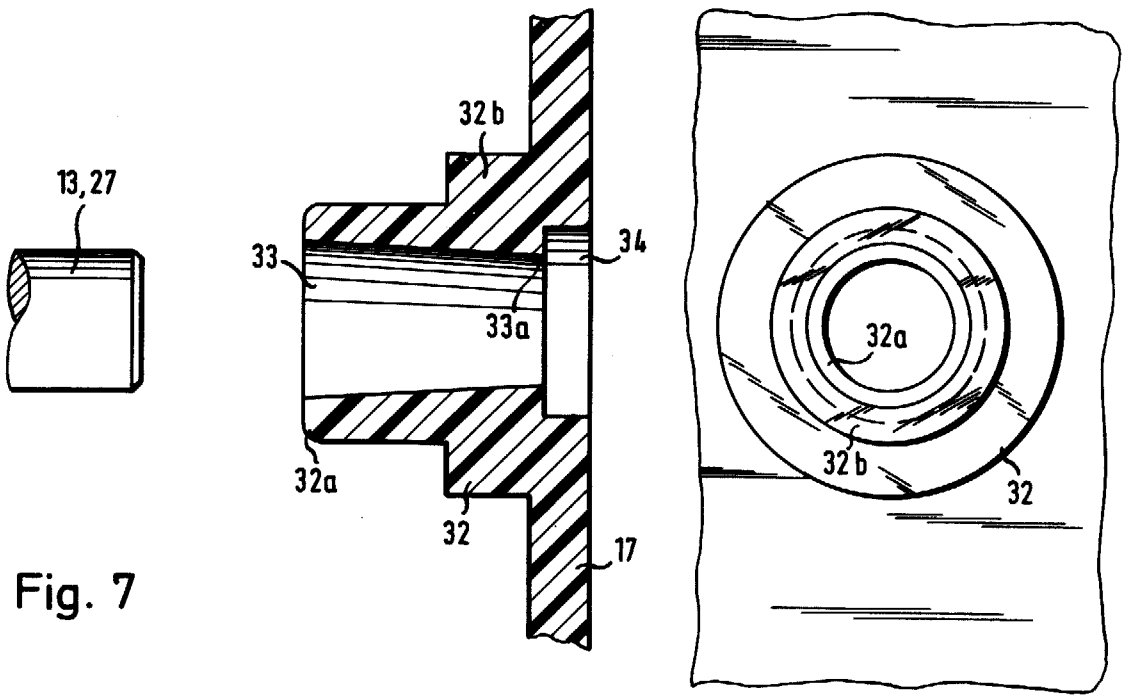
FIG. 7 shows a further embodiment of a door panel mounting or gripping arrangement between the projection and fastening pin, in which the bore of the projection is conically reduced or tapered away from the pin-engaging end thereof, and extends into an enlarged diameter recess which in depth corresponds substantially to the thickness of the door panel.

In the embodiment of FIG. 7 there is illustrated a door panel projection 32 which is also constructed in a stepwise manner at 32*a* and 32*b*, corresponding somewhat to the projections illustrated in FIGS. 4 through 6, and which has an annular ring-shaped reinforced construction of its wall. With respect to the foregoing structure, in the present case a bore 33 in the projection is conically shaped and tapered so as to reduce in size toward the end opposed to that providing for the insertion of pins 13, 17. The bore extends into an annular recess 34 at the end facing toward the decorative metal plate 18, as shown in FIGS. 2 and 3. The recess 34 is, in cross-section, somewhat larger than the maximum cross-sectional diameter of the bore 33, while its depths corresponds approximately to the thickness of the plate-shaped plastic material inner panel portion 17. The inner edge 33*a* of the bore adjoining the recess 34 provides for a relatively high surface pressure being exerted against the circumference of the pins 13, 17 which, together with the conical construction of the bore 33, permits the pin to be relatively easily introduced into the bore but to be removed from the projection 32 with extreme difficulty.

Figure 8:
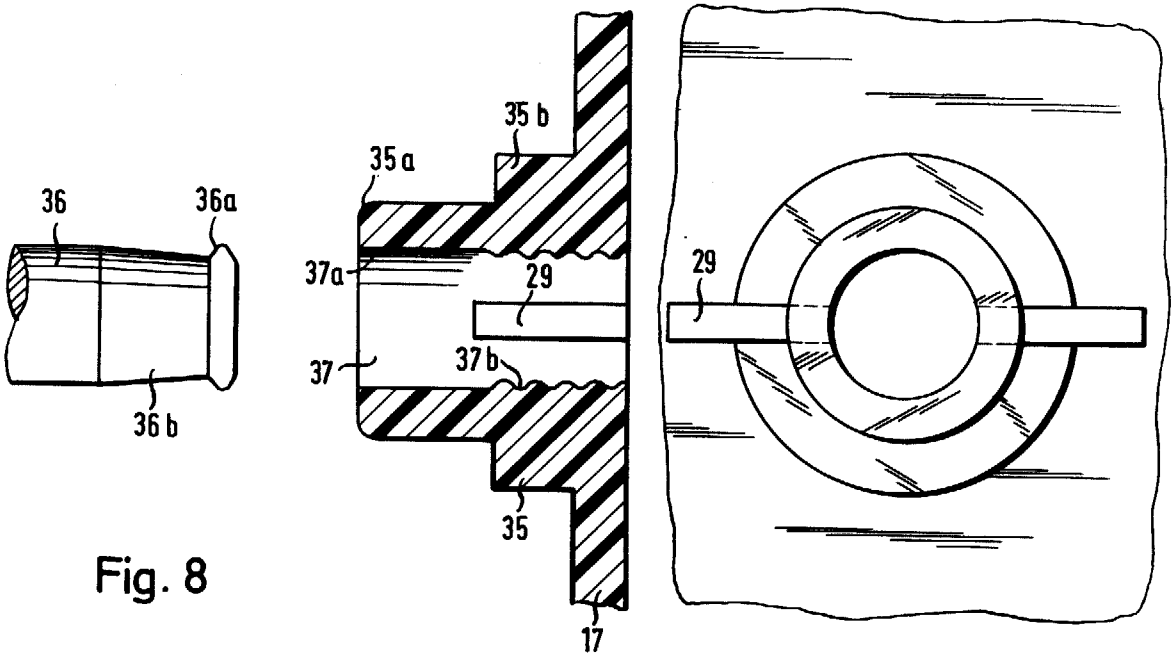
FIG. 8 illustrates a locking arrangement between a door panel projection and a fastening pin in which the door panel projection has slit side walls as in FIGS. 5 and 6, and with the end of the bore of the projection remote from the pin inserting end is provided with annular grooves which conform to and are adapted to grippingly engage a ring-shaped enlargement formed at the end of the pin insertable into the projection.

FIG. 8 illustrates a locking connection between a door panel projection 35 and a pin 36. The door panel projection is quite similar to those described in the other embodiments, and is stepwise formed at 35a and 35b so that the strength of the wall of the projection increases proportionately toward the plate-shaped plastic material inner panel portion 17. Additionally, the projection is provided with the slits 29 described in connection with the embodiment of FIG. 5. The inner surface of a bore 37 is, however, cylindrically formed in the region of the first portion 37*a* extending toward the end for insertion of pin 36, while, in effect, in the region of the reinforced projection wall 35*b* toward the ends of slits 29, the bore extends in transverse cross-section into a plurality of wave-shaped annular axially spaced grooves 37*b*.

The cross-sectional profile of each of these grooves corresponds to the profile of an annular ring-shaped enlargement 36*a* formed at the projection-engaging forward end of pin 36, and in which the annular ring-shaped enlargement adjoins a conically tapered reduced diameter pin portion 36*b*, prior to the pin extending into a similarly dimensioned and rounded shaft crosssection. Upon sliding the projections 35 onto the pin 36, the annular enlargement 36*a* engages itself in one of the annular grooves 37*b* so as to, in this manner, effect an extraordinarily firm connection between both components. In this instance, in preferred form, the projection together with the inner panel portion 17 may be integrally constructed of an elastically-plastic deformable material, which provides for the rigid but detachable connection between a door and door panel or door rosettes, while allowing numerous dismountings and applications thereof.

Figure 9:
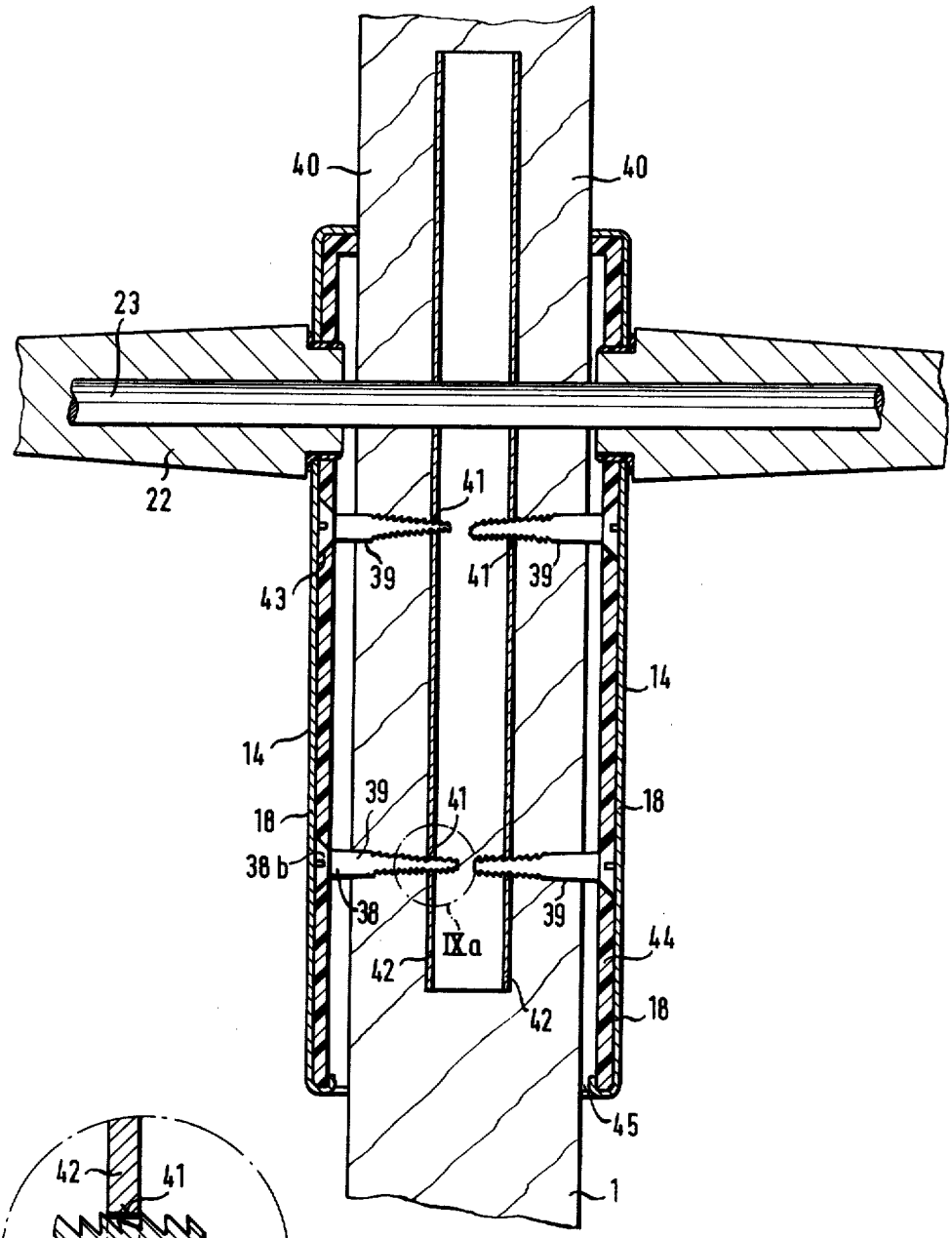
FIGS. 9 and 9*a* illustrate a further panel mounting arrangement according to the invention, in which door panels are rigidly and fixedly mounted on a door by means of plastic locking or self-gripping screw which extend into the door surface, and which are adapted to also extend into the wall structure of the door lock.
Figure 9A:
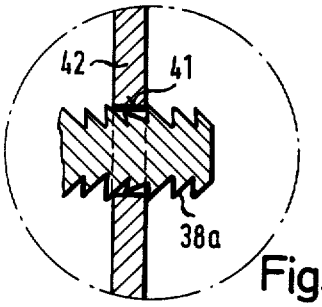

In the embodiment of FIG. 9 there is illustrated the mounting of the door panel 14 onto a door by means of plastic lock or self-gripping screws 38, the latter of which are provided with saw tooth-shaped teeth 38 angled rearwardly relative to the screw head, and which extend into apertures 39 formed in the wooden door element 40, and through holes 41 formed in the walls 42 of the lock receptacle. The spacing between the teeth is so determined whereby, as shown in enlarged detail in FIG. 9*a*, a representative annular tooth 38*a* lies within the aperture 41, while teeth positioned forwardly and rearwardly of the tooth 38*a* in aperture 41 provide for a rigid axial anchoring of the door panels on the door. The immovable mounting of the door panel relative to the door plane is ensured by means of the bores 39 in the door element 40.

The heads 38*b* of the self-gripping or lock screws are positioned in corresponding apertures 43 within the plastic material inner panel plate portion 44 in a manner whereby the upper surfaces of the screw heads are coextensive with the surface of the plastic material inner portion 44 which contacts the rear surface of the decorative panel metal plate 18. In this case there is also provided the possibility, by inserting a suitable screw driver (not illustrated), into one of the apertures 45 formed along the lower edge of the door panel, that the panel together with its mounting lock screw 38 may be plied away from the door. The mounting of two oppositely positioned door panels on both sides of the door by means of lock screws or mounting pins may naturally be effected through suitable bores which are located in the door only, so as to be independent of the lock. In order to effect the foregoing, in a modification of the previously described embodiments, the slitted wall portion along the bores in the porjections may be of a reduced crosssection section.

It is also possible that, independently of the recesses in the door, the mounting of the door panels or rosettes pursuant to the invention may be effected through the lock receptacle and/or the door, wherein in apertures provided in mass produced door locks there are mounted accurately spaced and measured pins, which are adapted to engage with their end extending through bores, the rosettes or door panels, and which are interengaged therewith so as to ensure against lateral displacement relative to the plane of the door, while effecting a compressive mounting of the door panel or the rosettes in the axial direction toward the door preventing the inadvertent pulling-away of the panels.

While there has been shown what is considered to be the preferred embodiment of the invention, it will be obvious that modifications may be made which come within the scope of the disclosure of the specification.

What is claimed is:

1. In an installation for mounting a door panel on at least one side of a hollow door; including a door lock-containing receptacle being positioned within the door from the forward surface thereof; at least one fastener means for securing said door panel to said door and being invisible from exteriorly of said door panel being immovably secured in said door in a direction towards the plane of the door; and fastener connecting means cooperating with said fastener means for securing said door panel against axial movement, the improvement comprising: said fastener means including at least one fastening pin located in a breakthrough in said receptacle in a gripping engagement, the ends of said pin projecting outwardly of and normally to the two surfaces of the door; said door panel including an outer ornamental plate portion and an inner plastic material portion fixedly connected thereto positioned intermediate the surface of the door and said plate portion, projecting means integrally formed with said plastic material portion and facing said pin, a bore formed in said projecting means in coaxial alignment with said pin, said pin having the end proximate said projecting means inserted into said bore in interference fit for preventing axial movement therebetween and to fixedly mount said door panel on said door.

2. Installation as claimed in claim 1, comprising an aperture extending through said door lock, said pin means being positioned in said aperture so as to extend therethrough.

3. Installation as claimed in claim 1, said pin means being an elongate pin having a substantially circular crosssection.

4. Installation as claimed in claim 1, said outwardly projecting pin means end portion including a plurality of annularly spaced axially extending parallel splines adapted to be inserted in the bore of said door panel projecting means in gripping engagement therewith.

5. Installation as claimed in claim 1, said bore in the door panel projecting means being conically tapered so as to have the larger bore end facing toward said pin means.

6. Installation as claimed in claim 1, the end of said projection means bore opposite to the end adapted to have said pin means inserted therein including a concentric recess portion having a cross-sectional diameter larger than that of the bore and a depth less than the thickness of the door panel.

7. Installation as claimed in claim 1, said pin means and said projecting means on said door panel being adapted to cooperatively form a locking connection.

8. Installation as claimed in claim 7, the end of said pin means projecting from the door being conically tapered toward a reduced diameter, said reduced diameter end including an enlarged annular ring-shaped member having a diameter corresponding to the main shaft portion of said pin means.

9. Installation as claimed in claim 8, said door panel bore comprising a plurality of axially spaced annular grooves adapted to engage the annular ring-shaped member at the end of said pin means so as to fasten together said pin means and said projecting means.

10. Installation as claimed in claim 4, said bore wall of the door panel projecting means directed away from said pin means including at least one longitudinal slit extending therethrough.

11. Installation as claimed in claim 1, said projecting means being cylindrically shaped and integrally connected with the rear surface of plate-like inner component of the door panel, said projecting means including a through-extending bore for receiving said pin means, and said projecting means and inner door panel component being constituted of an elasticallyplastically deformable material.

12. Installation as claimed in claim 11, the cylindrical bore wall of said projecting means in the region of juncture with said panel inner component being of an increased thickness.

13. Installation as claimed in claim 1, said fastening means for the door panel being fastened to the body of the door.

14. Installation as claimed in claim 1, said door panel being formed with an aperture along the lower edge thereof so as to provide for the insertion of panel-removing means.

15. Installation as claimed in claim 1, said door panel comprising a door rosette.

* * * * *